US011568844B2

(12) United States Patent
Chen et al.

(10) Patent No.: US 11,568,844 B2
(45) Date of Patent: Jan. 31, 2023

(54) NOISE CONTROL SYSTEM, A NOISE CONTROL DEVICE AND A METHOD THEREOF

(71) Applicant: System Elite Technology Corporation, Hsinchu (TW)

(72) Inventors: Hao-Ming Chen, Hsinchu (TW); Athena Tang, Hsinchu (TW)

(73) Assignee: SYSTEM ELITE TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 17/536,898

(22) Filed: Nov. 29, 2021

(65) Prior Publication Data

US 2022/0328028 A1 Oct. 13, 2022

(30) Foreign Application Priority Data

Apr. 8, 2021 (TW) ..... 110112823

(51) Int. Cl.
*G10K 11/178* (2006.01)
*G10K 11/16* (2006.01)

(52) U.S. Cl.
CPC ..... *G10K 11/16* (2013.01); *G10K 11/17825* (2018.01); *G10K 2210/3026* (2013.01); *G10K 2210/3027* (2013.01)

(58) Field of Classification Search
CPC ..... G10K 2210/3026; G10K 2210/3027
See application file for complete search history.

(56) References Cited

U.S. PATENT DOCUMENTS

2022/0189451 A1* 6/2022 Rui ..... G10K 11/17873
2022/0277722 A1* 9/2022 Chen ..... G10K 11/17817

* cited by examiner

*Primary Examiner* — Ping Lee
(74) *Attorney, Agent, or Firm* — Birch, Stewart, Kolasch & Birch, LLP

(57) ABSTRACT

A noise control system comprises a feedforward module, a feedback module, an error pre-processing module, and a signal integrating module. The feedforward module is configured to receive a reference signal and output a feedforward anti-noise signal by performing feedforward processing to the reference signal. The feedback module is configured to receive an error signal and output a feedback anti-noise signal by performing feedback processing to the error signal. The error pre-processing module is configured to receive the error signal and output a first pre-processing signal to the feedforward module and a second pre-processing signal to the feedback module. The signal integrating module is configured to output an integrated anti-noise signal integrated from the feedforward anti-noise signal and the feedback anti-noise signal. Wherein the first pre-processing signal corresponds to the first part of the error signal which belongs to the first frequency region; the second pre-processing signal corresponds to the second part of the error signal which belongs to the second frequency region.

12 Claims, 4 Drawing Sheets

NOISE CONTROL SYSTEM, A NOISE CONTROL DEVICE AND A METHOD THEREOF

FIELD OF THE INVENTION

The present invention generally relates to a noise control system, a noise control device, and a method thereof, in particular, a noise control system and a noise control device having an error pre-processing module, and a method thereof.

BACKGROUND OF THE INVENTION

Modern people pursue a higher quality of life. For this reason, they also pursue a quieter and more comfortable environment. One example is that the demand for improved noise reduction when riding on or driving vehicles or using audio-visual equipment such as headphones has been increasing. Another example is, when using medical equipment and other applications susceptible to noise, the quality of the results can be improved if noise is reduced.

Currently, common noise reduction methods can be divided into passive noise reduction and active noise reduction. Passive noise reduction can be, for example, using sound-absorbing materials or sound-insulating materials to reduce the transmission of sound. However, passive noise reduction may be limited by the environment where it is conducted or the frequency band of the noise. Hence, active noise reduction is often used to improve the effect of reducing noise.

Active noise reduction is, for example, offsetting sounds by generating offset sounds of similar amplitude but opposite phase (with phase difference being 180°). However, generating offset sounds based on noise requires considerable processing speed of the hardware and/or software. Besides, to offset sounds needs repeated calculation to achieve convergence in order to achieve the best noise reduction effect. When the convergence time is too long, the effect of noise reduction will also be affected. Therefore, how the convergence speed of the noise control system may be improved is one of the issues for the development of this field.

SUMMARY OF THE INVENTION

In an embodiment, a noise control system of the present invention comprises a feedforward module, a feedback module, an error pre-processing module and a signal integrating module. The feedforward module is configured to receive a reference signal and output a feedforward anti-noise signal by performing a feedforward processing to the reference signal. The feedback module is configured to receive an error signal and output a feedback anti-noise signal by performing a feedback processing to the error signal. The error pre-processing module is configured to receive the error signal and output a first pre-processing signal to the feedforward module and a second pre-processing signal to the feedback module. The signal integrating module is configured to output an integrated anti-noise signal integrated from the feedforward anti-noise signal and the feedback anti-noise signal. Wherein the first pre-processing signal corresponds to the first part of the error signal which belongs to the first frequency region; the second pre-processing signal corresponds to the second part of the error signal which belongs to the second frequency region.

In an embodiment, the present invention provides a noise controlling device comprising: the aforementioned noise control system, first vibration sensor, sound producer and second vibration sensor. The first vibration sensor is configured to sample a target sound and output the reference signal. The sound producer is configured to receive the integrated anti-noise signal and produce an offset sound. The second vibration sensor is configured to sample a noise-reduced sound and output the error signal. Wherein the first pre-processing signal corresponds to the first part of the error signal which belongs to the first frequency region, and the second pre-processing signal corresponds to the second part of the error signal which belongs to the second frequency region. Wherein the noise-reduced sound is the sum of the target sound and the offset sound.

In an embodiment, the present invention provides a noise control method, comprising: receiving an error signal and outputting a first pre-processing signal and a second pre-processing signal; wherein the first pre-processing signal corresponds to the first part of the error signal which belongs to the first frequency region, and the second pre-processing signal corresponds to the second part of the error signal which belongs to the second frequency region; receiving a reference signal and outputting a feedforward anti-noise signal after performing feedforward processing to the reference signal; outputting a feedback anti-noise signal after performing feedback processing to the error signal; and integrating the feedforward anti-noise signal and the feedback anti-noise signal and outputting an integrated anti-noise signal.

As described above, the error pre-processing module generates different pre-processing signals based on different frequency intervals/regions and provides the different pre-processing signals to the feedforward module for feedback accordingly. As a result, the calculation efficiency of the feedforward module and the feedback module may be improved and the convergence speed of the noise control system may be improved.

DETAILED DESCRIPTION OF THE PREFERRED EMBODIMENTS

The connecting elements according to the present invention will be described in detail below through embodiments and with reference to the accompanying drawings. A person having ordinary skill in the art may understand the advantages and effects of the present disclosure through the contents disclosed in the present specification.

It should be understood that, even though the terms such as "first", "second", "third" may be used to describe an element, a part, a region, a layer and/or a portion in the present specification, but these elements, parts, regions, layers and/or portions are not limited by such terms. Such terms are merely used to differentiate an element, a part, a region, a layer and/or a portion from another element, part, region, layer and/or portion. Therefore, in the following discussions, a first element, portion, region, portion may be called a second element, portion, region, layer or portion, and do not depart from the teaching of the present disclosure. The terms "comprise", "include" or "have" used in the present specification are open-ended terms and mean to "include, but not limit to."

Unless otherwise particularly indicated, the terms, as used herein, generally have the meanings that would be commonly understood by those of ordinary skill in the art. Some terms used to describe the present disclosure are discussed below or elsewhere in this specification to provide additional guidance to those skilled in the art in connection with the description of the present disclosure.

As used herein, the term "coupled to" in the various tenses of the verb "couple" may mean that element A is directly connected to element B or that other elements may be connected between elements A and B (i.e., that element A is indirectly connected with element B). In the case of electrical components, the term "coupled to" may also be used herein to mean that a wire, trace, or other electrically conductive material is used to electrically connect elements A and B (and any components electrically connected therebetween). In some examples, the term "coupled to" indicates having an electric current flowing between the elements A and B. In some examples, the term "electrically connected" may indicate having an electric current flowing between the elements A and B.

Figure 1A:
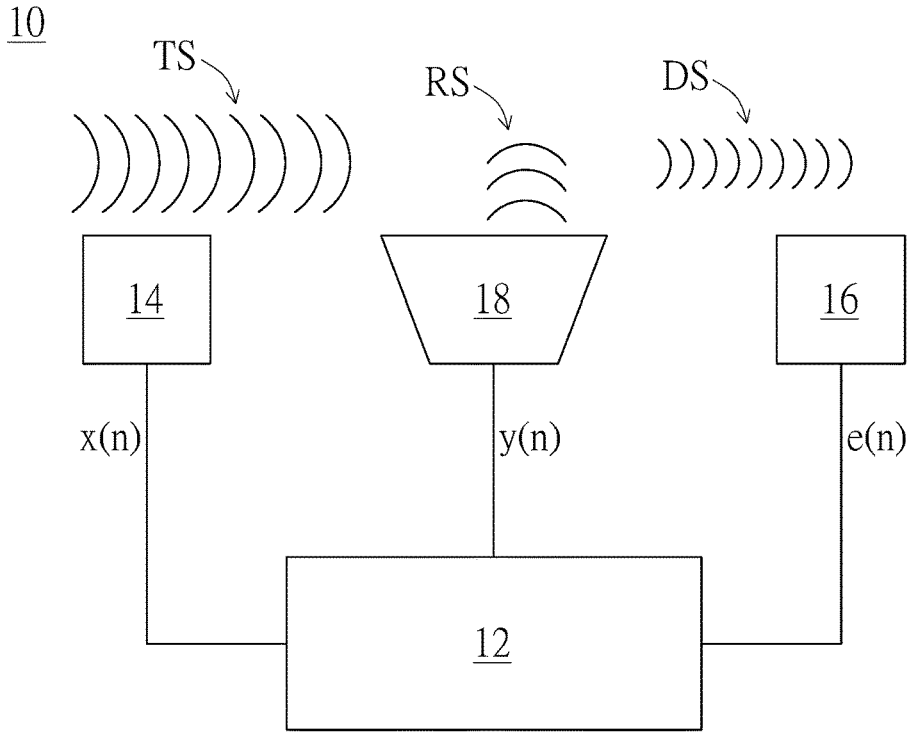
FIG. 1A is a schematic view of the noise control device handling target sounds according to an embodiment of the present invention.

Refer to FIG. 1A. The present invention provides a noise control device 10 comprising the noise control system 12, the first vibration sensor 14, the second vibration sensor 16 and the sound producer 18. The first vibration sensor 14 is configured to sample the target sound TS and output the reference signal x(n). The sound producer 18 is configured to receive the integrated anti-noise signal y(n) and output the offset sound RS. The second vibration sensor 16 is configured to sample the noise-reduced sound DS and output the error signal e(n). Wherein the noise-reduced sound is the sum of the target sound TS and the offset sound RS. More specifically, the first vibration sensor 14 and the second vibration sensor 16 can be, for example, microphones, piezoelectric materials, or components to sample mechanical energy (vibration) and so on. The sound producer 18 can be, for example, a speaker, piezoelectric material, or components to output mechanical energy and so on. The reference signal x(n) and the error signal e(n) are digital signal or analog signal produced by a microphone. The integrated anti-noise signal y(n) is calculated by the noise control system 12 and sent to the sound producer 18. The integrated anti-noise signal y(n) can be either a digital signal or analog signal. The integrated anti-noise signal y(n) is transformed to mechanical energy from electrical energy by the sound producer 18. Preferably, the amplitude of the offset sound RS is substantially equal or close to the amplitude of the target sound TS but of opposite phase to generate the noise-reduced sound. It should be noted that the opposite phase of the offset sound RS and target sound TS is only a basic concept; the relationship between the amplitude and phase of the offset sound RS and target sound TS is also affected by the included angle or transmission medium between the offset sound RS and the target sound TS. Moreover, the transmission directions of the target sound TS, the offset sound RS and the noise-reduced sound DS shown in FIG. 1A are only schematic and are not used to limit the sound transmission direction of the noise control device 10 of the present invention.

Figure 1B:
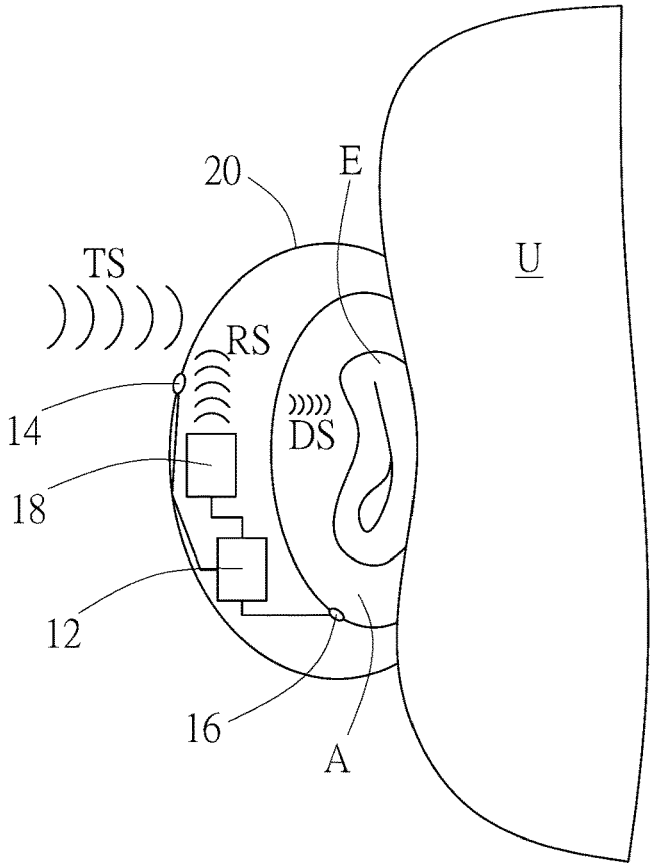
FIG. 1B is a schematic view of the application and arrangement of the noise control device according to an embodiment of the present invention.
Figure 2:
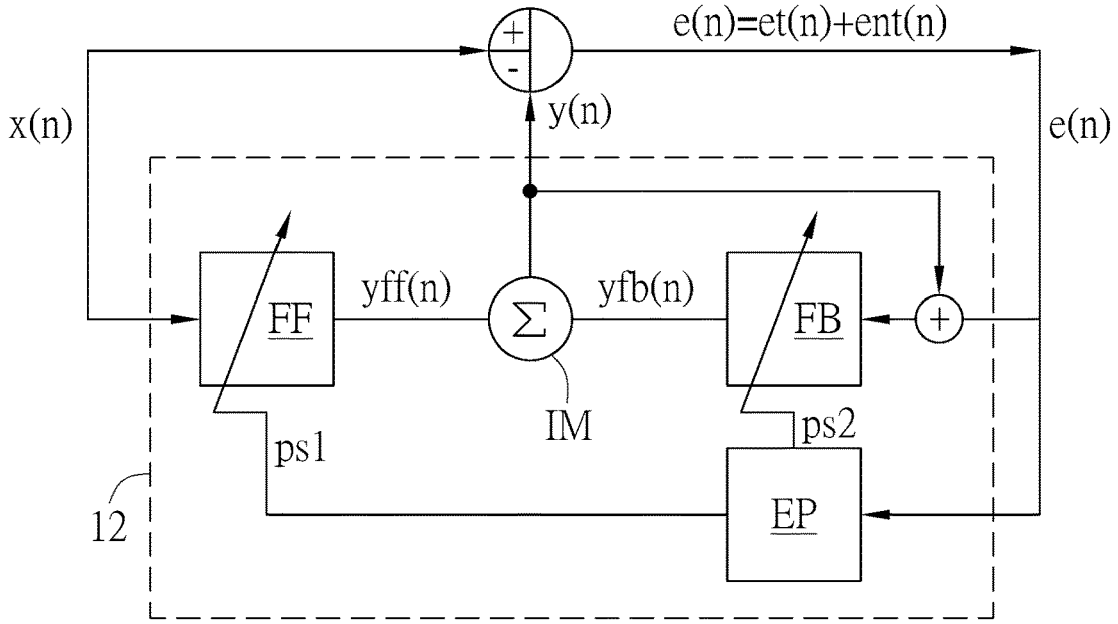
FIG. 2 is a simple block diagram of the noise control system according to an embodiment of the present invention.

In an embodiment, the noise control device 10 can be arranged in an electronic device such as a headphone. As shown in FIG. 1B, the first vibration sensor 14 of the noise control device 10 is, preferably, arranged outside of the housing 20 of the headphone, and the second vibration sensor 16 is, preferably, arranged in the housing 20 of the headphone. More specifically, a vocal cavity A is formed between the housing 20 of the headphone and the user' ear. The first vibration sensor 14 is arranged outside of the vocal cavity A, the second vibration sensor 16 is arranged in the vocal cavity A. In other words, the first vibration sensor 14 is, preferably, arranged at a location in the electronic device for receiving noise from outside, and the second vibration sensor 16 is, preferably, arranged at a location where a user U or a receiver needs to reduce the impact of noise. The first vibration sensor 14 can receive the target sound TS outside the housing 20 of the headphone and output the reference signal x(n) to the noise control system 12. The second vibration sensor 16 can receive the noise-reduced sound DS inside the housing 20 of the headphone and output the error signal e(n) to the noise control system 12. The sound producer 18 can be arranged but not limited to being arranged in the housing 20 of the headphone and provide the offset sound RS to the transmission path of the target sound TS to be summed up with the target sound TS. It should be noted that the noise-reduced sound DS can be the sum of the target sound TS and the offset sound RS further passed through passive noise reduction material(s) (for example, sound-absorbing materials arranged in the housing 20 or other transmission path of sounds). The noise reduction effect of the noise control device 10 can be detected by the second vibration sensor 16. The second vibration sensor 16 can provide the error signal e(n) to the noise control system 12 to correct/modify and update the integrated anti-noise signal y(n) to minimize the error signal e(n) (in general, the user U will not hear the target sound TS). However, FIG. 1B merely illustrates the arrangement position and relative relationship among the first vibration sensor 14, second vibration sensor 16 and the sound producer 18, and/or the combination with possible electronic devices. The present invention should not be limited by the example of FIG. 1B. Any noise control device applied to the noise control system 12 disclosed in the specification shall belong to the scope of the invention Refer to FIG. 2. The present invention provides the noise control system 12 comprising the feedforward module FF, the feedback module FB, the error pre-processing module EP and the signal integrating module IM. The feedforward module FF receives the reference signal x(n) and outputs the feedforward anti-noise signal yff(n) after performing the feedforward processing W(z) to the reference signal x(n). The feedback module FB receives the error signal e(n) and outputs the feedback anti-noise signal yfb(n) after performing the feedback processing M(z) to the error signal e(n). The error pre-processing module EP receives the error signal e(n) and outputs the first pre-processing signal ps1 to the feedforward module FF, and the second pre-processing signal ps2 to the feedback module FB. The signal integrating module IM is configured to integrate the feedforward anti-noise signal yff(n) and the feedback anti-noise signal yfb(n) and output the integrated anti-noise signal y(n). In other words, the integrated anti-noise signal y(n) is the integrated result of the sum or other operation(s) or calculation(s) of the feedforward anti-noise signal yff(n) and the feedback anti-noise signal yfb(n). Wherein the first pre-processing signal ps1 corresponds to the first part of the error signal e(n) which belongs to the first frequency region, and the second pre-processing signal ps2 corresponds to the second part of the error signal e(n) which belongs to the second frequency region. In a preferred embodiment, the first frequency region is a frequency region under 2 k Hz, and the second frequency region is between 2 K Hz and 5 K Hz. It should be noted that the invention is not limited to the frequency range (20 Hz to 20 kHz) that can be sensed by human ears. Moreover, the first part and the second part in this embodiment are distinguished by the frequency region/interval to which they belong; the invention does not limit the signal properties of the first part or the second part.

In an embodiment, the error signal e(n) can have an aperiodic first part ent(n) and a periodic second part et(n). Preferably, the aperiodic part ent(n) often occurs in the low frequency band. The feedforward module FF mainly processes signals in low frequency band. If only the first part ent(n) of the error signal e(n) is provided to the feedforward module FF, by avoiding the influence of high-frequency noises, the convergence rate of the feedforward module FF may be improved. In another aspect, compared to the first part ent(n), the second part et(n) has higher frequencies. The feedback module FB mainly processes periodic signals. If only the second part et(n) of the error signal e(n) is provided to the feedback module FB, the convergence rate of feedback module FB can be improved by avoiding irregular noise. In a preferred embodiment, through artificial intelligence (AI) or big data or other related technologies, the error signal e(n) can be trained and inferenced to achieve better convergence ability. Besides, since the first pre-processing signal ps1 corresponds to the first part ent(n) which belongs to the first frequency region in error signal e(n), when outputting the first pre-processing signal ps1 to the feedforward module FF, the first part ent(n) of the error signal e(n) can be directly sent to the feedforward module FF, or it can be sent to the feedforward module FF after amplification or other signal processing. Similarly, since the second pre-processing signal ps2 corresponds to the second part et(n) which belongs to the second frequency region in the error signal e(n), when outputting the second pre-processing signal ps2 to the feedback module FB, the second part et(n) of the error signal e(n) can be directly sent to the feedback module FB, or it can be sent to the feedback module FB after amplification or other signal processing.

In a preferred embodiment, the feedforward module FF is configured to adjust the parameter(s) of the feedforward processing W(z) based on the first pre-processing signal ps1, and the feedback module FB is configured to adjust the parameter(s) of the feedback processing M(z) based on the second pre-processing signal ps2. More specifically, the method to calculate the parameters of the feedforward processing W(z) and the feedback processing M(z) can be but not limited to Least Mean Square (LMS) method, Least Square method or any other conventional method to minimize error. The feedforward module FF can adjust the parameter(s) of the feedforward processing W(z) based on the first pre-processing signal ps1 to improve the convergence rate of the feedforward module FF; the feedback module FB can adjust the parameter(s) of feedback processing M(z) based on the second pre-processing signal ps2 to improve the convergence rate of the feedback module FB.

Figure 3:
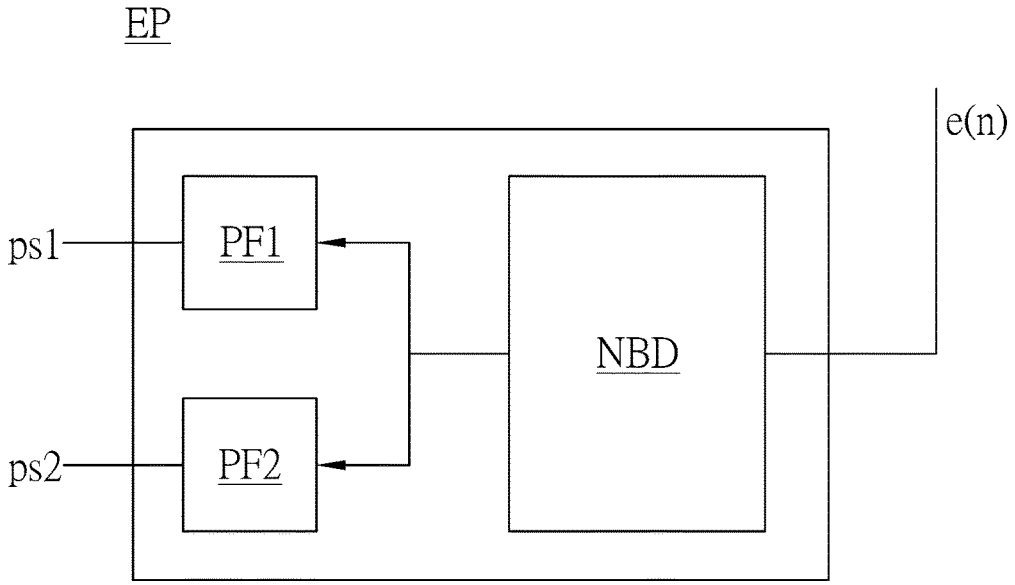
FIG. 3 is a schematic view of the error pre-processing module according to an embodiment of the present invention.

Refer to FIG. 3. In a preferred embodiment, the error pre-processing module EP comprises the noise bandwidth detecting element NBD, the first pre-filtering element PF1 and the second pre-filtering element PF2. The noise bandwidth detecting element NDB is configured to receive the error signal e(n) and compute the frequency distribution of the error signal e(n). More specifically, the noise bandwidth detecting element NBD can be a microprocessor (MCU), a field programmable gate array (FPGA) or any element with the ability of computing. The method of computing the frequency distribution of the error signal e(n) can be but not limited to Discrete Fourier Transform (DFT), Fast Fourier Transform (FFT) or any method of estimating frequency domain. The first pre-filtering element PF1 is coupled to the noise bandwidth detecting element NBD and configured to output the first pre-processing signal ps1. The second pre-filtering element PF2 is coupled to the noise bandwidth detecting element NBD and configured to output the second pre-processing signal ps2. Preferably, the first pre-filtering element can be a low-pass filter, and the second pre-filtering element PF2 a band-pass filter. It should be noted that the second pre-filtering element PF2 can also be formed by a low-pass filter and a high-pass filter to achieve the effect of a band-pass filter. In a preferred embodiment, the first pre-filtering element PF1 and the second pre-filtering element PF2 can be an infinite impulse response (IIR) filter.

In an embodiment, the filtering region of the first pre-filtering element PF1 and the second pre-filtering element PF2 can be adjusted by the noise bandwidth detecting element NBD. In other words, the noise bandwidth detecting element NBD can compute the frequency distribution of the error signal e(n) and adjust the filtering region of the first pre-filtering element PF1 and the second pre-filtering element PF2. More specifically, since the first pre-filtering element PF1 is a low-pass filter, the filtering threshold of the first pre-filtering element PF1 can be set by the noise bandwidth detecting element NBD (for example, under 2 k Hz) to determine the frequency region of the signals passing through the first pre-filtering element PF1. Similarly, since the second pre-filtering element PF2 is a band-pass filter or high pass filter, when the error signal e(n) has signal section(s) that occur periodically, the noise bandwidth detecting element NBD will adjust the second frequency region according to the signal section(s) (for example, 2 k-5 k Hz).

In an embodiment, the noise bandwidth detecting element NBD can be improved by, for example, machine learning, deep learning or neural networks analysis to optimize the filtering region of the first pre-filtering element PF1 and the second pre-filtering element PF2. For example, before receiving noise or activating the noise control system, the noise bandwidth detecting element NBD can detect the background error signal from ambient environment to establish/train a database. When activating the noise control system 12 or receiving the target sound TS, the noise bandwidth detecting element NBD can use parameters stored in the database to improve the response rate of the noise control system 12.

Figure 4:
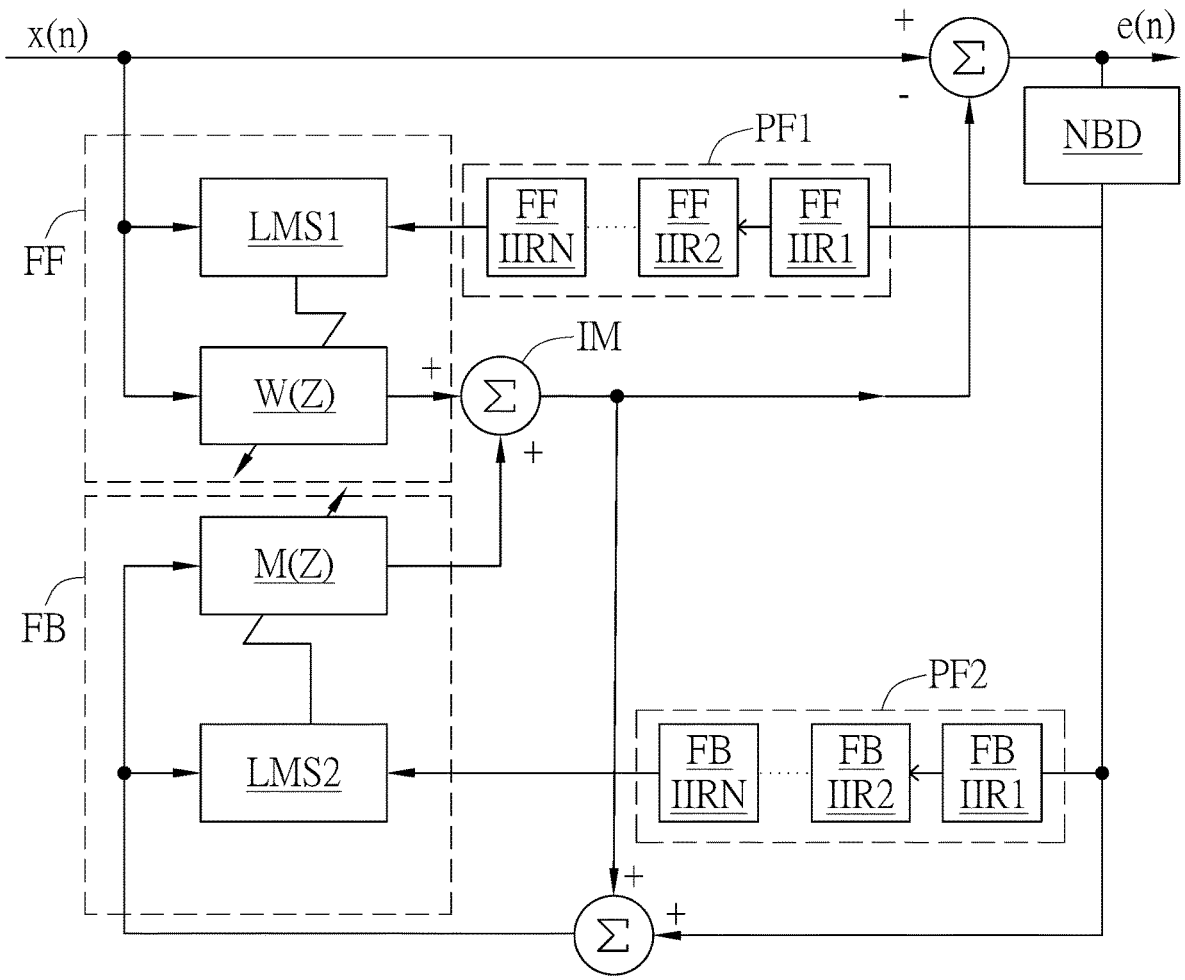
FIG. 4 is a schematic view of the operation among the noise control system and each of the modules according to an embodiment of the present invention.

Refer to FIG. 4. FIG. 4 illustrates the noise control system 12 of the present invention according to a preferred embodiment. The first pre-filtering element PF1 can be formed by N infinite impulse response filters FF-IIR1-FF-IIRN, and the second pre-filtering element can be formed by N infinite impulse response filters FB-IIR1-FB-IIRN. The feedforward module FF comprises the feedforward processing element W(z) and the first signal processing element LMS1. The feedback module FB comprises the feedback processing element M(z) and the second signal processing element LMS2. In the embodiment, it should be noted that the attenuation function on the transmission line is omitted for simplicity of description. The noise bandwidth detecting element NBD can adjust the parameter of each of the infinite impulse response filters, FF-IIR1-FF-IIRN and FB-IIR1-FB-IIRN, based on the frequency distribution of the error signal e(n). The first pre-processing signal ps1 and the second pre-processing signal ps2 are respectively sent to the first signal processing element LMS1 and the second signal processing element LMS2. The first signal processing element LMS1 and the second signal processing element LMS2 can adjust the parameter of the feedforward processing element W(z) and the feedback processing element M(z) according to the first pre-processing signal ps1 and the second pre-processing signal ps2, respectively.

Figure 5:
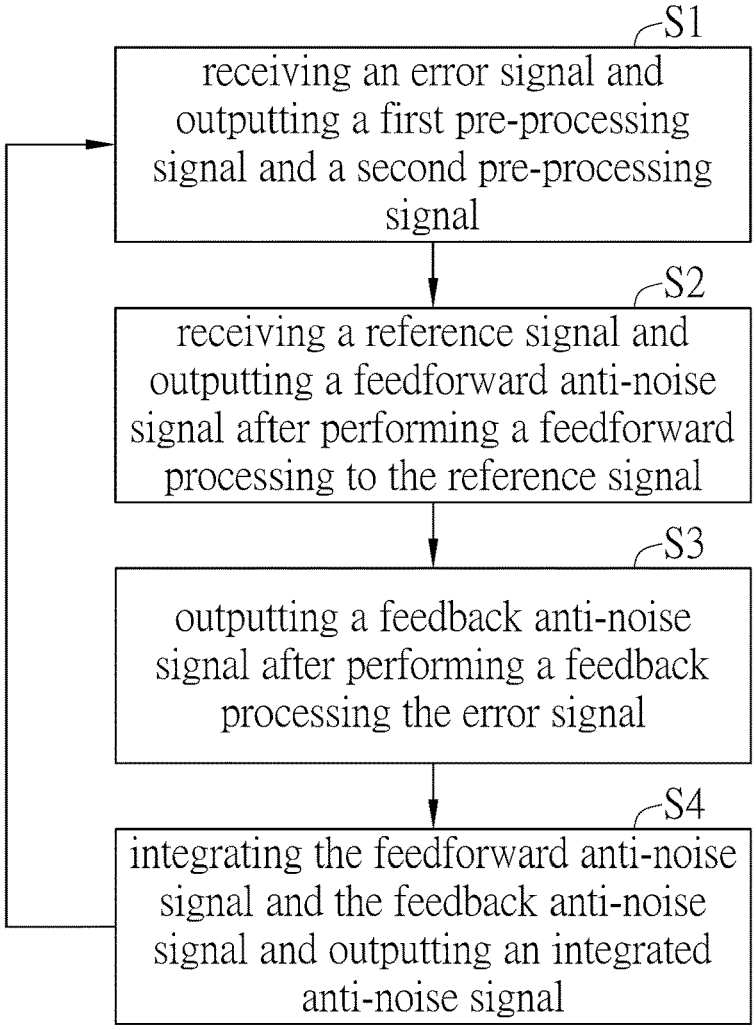
FIG. 5 is a flow chart of the noise control method according to an embodiment of the present invention.

Refer to FIG. 5. The present invention provides a noise control method comprising: Step S1: Receiving an error signal and outputting a first pre-processing signal and a second pre-processing signal; wherein the first pre-processing signal corresponds to the first part of the error signal which belongs to the first frequency region, and the second pre-processing signal corresponds to the second part of the error signal which belongs to the second frequency region. Step S2: Receiving a reference signal and outputting a feedforward anti-noise signal after performing feedforward processing to the reference signal. Step S3: Outputting a feedback anti-noise signal after performing feedback processing to the error signal. Step S4: Integrating the feedforward anti-noise signal and the feedback anti-noise signal and outputting an integrated anti-noise signal. It should be noted that after outputting the integrated anti-noise signal in step S4, the error signal will be received again to determine whether the integrated anti-noise signal needs to be adjusted. For example, if the error signal is still too large or does not meet the expectation for noise reduction effect, go back to step S1 until the expected noise reduction effect is achieved.

The foregoing disclosure is merely preferred embodiments of the present invention and is not intended to limit the claims of the present invention. Any equivalent technical variation of the description and drawings of the present invention of the present shall be within the scope of the claims of the present invention.

What is claimed is:

1. A noise control system, comprising:

a feedforward module configured to receive a reference signal and output a feedforward anti-noise signal by performing feedforward processing to the reference signal;

a feedback module configured to receive an error signal and output a feedback anti-noise signal by performing feedback processing to the error signal;

an error pre-processing module configured to receive the error signal and output a first pre-processing signal to the feedforward module and output a second pre-processing signal to the feedback module; and a signal integrating module configured to integrate the feedforward anti-noise signal and the feedback anti-noise signal to output an integrated anti-noise signal;

wherein the first pre-processing signal corresponds to a first part of the error signal which belongs to a first frequency region; the second pre-processing signal corresponds to a second part of the error signal which belongs to a second frequency region;

wherein the first frequency region is at least partially lower than the second frequency region.

2. The noise control system of claim 1, wherein the error pre-processing module comprises:

a component of noise bandwidth detection configured to receive the error signal;

a first pre-filtering component coupled to the component of noise bandwidth detection and configured to output the first pre-processing signal; and a second pre-filtering component coupled to the component of noise bandwidth detection and configured to output the second pre-processing signal.

3. The noise control system of claim 2, wherein the first pre-filtering component is a low-pass filter, and the second pre-filtering component is a band-pass filter.

4. The noise control system of claim 2, wherein the first pre-filtering component and the second pre-filtering component are infinite impulse response filters.

5. The noise control system of claim 2, wherein the error signal has a periodic signal component, and the component of noise bandwidth detection adjusts the second frequency region based on the periodic signal component.

6. The noise control system of claim 2, wherein the component of noise bandwidth detection computes the frequency distribution of the error signal and adjusts the filtering region of the first pre-filtering component and the second pre-filtering component based on the frequency distribution.

7. The noise control system of claim 1, wherein the feedforward module adjusts at least a parameter of the feedforward processing according to the first pre-processing signal; the feedback module adjusts at least a parameter of the feedback processing according to the second pre-processing signal.

8. A noise controlling device, comprising:

a noise control system, comprising:

a feedforward module configured to receive a reference signal and output a feedforward anti-noise signal by performing feedforward processing to the reference signal;

a feedback module configured to receive an error signal and output a feedback anti-noise signal by performing feedback processing to the error signal;

an error pre-processing module configured to receive the error signal and output a first pre-processing signal to the feedforward module and a second pre-processing signal to the feedback module; and a signal integrating module configured to integrate the feedforward anti-noise signal and the feedback anti-noise signal to output an integrated anti-noise signal; and a first vibration sensor configured to sample a target sound and output the reference signal;

a sound producer configured to receive the integrated anti-noise signal and produce an offset sound; and a second vibration sensor configured to sample a noise-reduced sound and output the error signal;

wherein the first pre-processing signal corresponds to a first part of the error signal which belongs to a first frequency region, and the second pre-processing signal corresponds to a second part of the error signal which belongs to a second frequency region;

wherein the noise-reduced sound is the sum of the target sound and the offset sound;

wherein the first frequency region is at least partially lower than the second frequency region.

9. A noise control method, comprising:

receiving an error signal and outputting a first pre-processing signal and a second pre-processing signal; wherein the first pre-processing signal corresponds to a first part of the error signal which belongs to a first frequency region, and the second pre-processing signal corresponds to a second part of the error signal which belongs to a second frequency region;

receiving a reference signal and outputting a feedforward anti-noise signal after performing feedforward processing to the reference signal;

outputting a feedback anti-noise signal after performing feedback processing to the error signal; and integrating the feedforward anti-noise signal and the feedback anti-noise signal and outputting an integrated anti-noise signal;

wherein the first frequency region is at least partially lower than the second frequency region.

10. The noise control method of claim 9, wherein the error signal has a periodic signal component, and a component of noise bandwidth detection adjusts the second frequency region based on the periodic signal component.

11. The noise control method of claim 9, when receiving the error signal and outputting the first pre-processing signal and the second pre-processing signal, computing the frequency distribution of the error signal, and adjusting the filtering region of the first pre-filtering component and the second pre-filtering component based on the frequency distribution.

12. The noise control method of claim 9, wherein the feedforward module adjusts at least a parameter for the feedforward processing according to the first pre-processing signal; the feedback module adjusts at least a parameter for the feedback processing according to the second pre-processing signal.

* * * * *